US009903642B2

(12) United States Patent
Bassler et al.

(10) Patent No.: US 9,903,642 B2
(45) Date of Patent: Feb. 27, 2018

(54) REFRIGERATION DEVICE HAVING A TRAY

(71) Applicant: BSH BOSCH UND SIEMENS HAUSGERÄTE GmbH, München (DE)

(72) Inventors: Daniel Bassler, Aalen (DE); Herbert Cizik, Ottenbach (DE); Jürgen Fink, Gerstetten (DE)

(73) Assignee: BSH Hausgeräte GmbH, Munich (DE)

( * ) Notice: Subject to any disclaimer, the term of this patent is extended or adjusted under 35 U.S.C. 154(b) by 312 days.

(21) Appl. No.: 14/418,490

(22) PCT Filed: Jul. 17, 2013

(86) PCT No.: PCT/EP2013/065112
§ 371 (c)(1),
(2) Date: Jul. 17, 2015

(87) PCT Pub. No.: WO2014/019856
PCT Pub. Date: Feb. 6, 2014

(65) Prior Publication Data

US 2015/0316314 A1 Nov. 5, 2015

(30) Foreign Application Priority Data

Jul. 31, 2012 (DE) ..... 10 2012 213 425

(51) Int. Cl.
*A47B 96/04* (2006.01)
*F25D 25/02* (2006.01)
(Continued)

(52) U.S. Cl.
CPC ..... *F25D 25/024* (2013.01); *F25D 23/00* (2013.01); *F25D 23/08* (2013.01); *F25D 25/021* (2013.01);
(Continued)

(58) Field of Classification Search
CPC ..... F25D 25/02; A47B 2210/0043
(Continued)

(56) References Cited

U.S. PATENT DOCUMENTS 1,341,829 A * 6/1920 Whittinghill ..... F24C 15/16 126/339
2,955,441 A 3/1959 Dahlgren et al.
(Continued)

FOREIGN PATENT DOCUMENTS

CN 101170926 4/2008
CN 101688750 3/2010
(Continued)

OTHER PUBLICATIONS

International Search Report for PCT/EP2013/065112, dated Nov. 11, 2013, two pages.
(Continued)

*Primary Examiner* — Matthew W Ing
(74) *Attorney, Agent, or Firm* — Nixon & Vanderhye P.C.

(57) ABSTRACT

The invention relates to a refrigeration device having an interior space, in which a compartment bottom is arranged. According to the invention, a tray movably supported on rollers is arranged on the compartment bottom. The invention further relates to such a tray.

25 Claims, 5 Drawing Sheets

(51) Int. Cl.
*F25D 23/00* (2006.01)
*F25D 23/08* (2006.01)

(52) U.S. Cl.
CPC ..... *F25D 25/022* (2013.01); *F25D 25/025* (2013.01); *F25D 2325/022* (2013.01)

(58) Field of Classification Search
USPC ..... 312/334.6, 334.14, 334.15, 334.27, 312/334.32, 334.33, 334.36, 334.39, 312/334.42, 334.43, 334.18, 334.21, 404, 312/408, 410, 348.3; 108/92, 93
See application file for complete search history.

(56) References Cited

U.S. PATENT DOCUMENTS

| | | | | |
|---|---|---|---|---|
| 3,178,249 | A | 6/1962 | Willis et al. | |
| 4,600,255 | A * | 7/1986 | Dubarko | E05B 65/46 108/143 |
| 6,129,433 | A * | 10/2000 | Rosenberg | A47B 88/20 220/8 |
| 6,328,364 | B1 * | 12/2001 | Darbishire | B60P 1/003 296/26.09 |
| 7,140,703 | B1 * | 11/2006 | Holdgate, III | A47B 88/18 312/323 |
| 2009/0151758 | A1 * | 6/2009 | Kristensson | A47L 15/507 134/201 |
| 2012/0153794 | A1 * | 6/2012 | Busalt | F24C 15/16 312/334.21 |

FOREIGN PATENT DOCUMENTS

| | | |
|---|---|---|
| CN | 102245986 | 11/2011 |
| CN | 102483295 | 5/2012 |
| DE | 20 2009 000857 | 7/2010 |
| DE | 10 2010 004219 | 9/2010 |
| GB | 693 733 | 7/1953 |
| JP | 9-280727 A | 10/1997 |
| JP | H09-280727 | 10/1997 |
| JP | 2000-139641 | 5/2000 |
| RU | 2 301 383 | 1/2006 |
| RU | 2 427 770 | 6/2010 |

OTHER PUBLICATIONS

Non-English Written Opinion of the ISA for PCT/EP2013/065112, dated Nov. 11, 2013, six pages.
Summary of First Office Action issued in related Russian Application No. 2015103117 dated Aug. 17, 2016, 2 pages.

* cited by examiner

REFRIGERATION DEVICE HAVING A TRAY

This application is the U.S. national phase of International Application No. PCT/EP2013/065112 filed 17 Jul. 2013 which designated the U.S. and claims priority to DE Patent Application No. 10 2012 213 425.5 filed 31 Jul. 2012, the entire contents of each of which are hereby incorporated by reference.

The invention relates to a refrigeration device having an interior in which a shelf is arranged. The invention further relates to a tray for such a refrigeration device.

Refrigeration devices, in particular refrigeration devices configured as domestic appliances, are known and are used for household management in the home or in the catering field in order to store perishable foodstuffs and/or beverages at specific temperatures.

A refrigeration device is disclosed in DE 10 2010 004 219 A1 which has a shelf fixedly arranged in an inner container of the refrigeration device as well as a component which is able to be pulled out and pushed in relative to the shelf. The component runs on rollers which are arranged directly or indirectly in or on the shelf. Such rollers remain, however, in the inner container when the shelf is not inserted into the inner container and therefore impair the visual appearance of the inner container.

It is, therefore, the object underlying the invention to provide a refrigeration device having a more visually attractive appearance.

These objects are achieved by the subjects of the invention having the features according to the independent claims. Advantageous developments form the subject matter of the dependent claims.

The present invention is based on the recognition that a particularly visually attractive interior of a refrigeration device is achieved by a tray which is supported in a displaceable manner on rollers on the shelf.

According to a first feature, the object according to the invention is achieved by a refrigeration device in which a tray supported in a displaceable manner on rollers is arranged on the shelf. As a result, the technical advantage is achieved that the tray may be pulled out of the interior of the refrigeration device when the refrigeration device is open, in order to deposit items to be refrigerated on the tray, such as for example perishable foodstuffs and/or beverages, or to remove refrigerated goods. Thus the ease of use of the refrigeration device is increased during operation. Alternatively, the tray may be taken as a whole with the refrigerated goods on the tray out of the interior of the refrigeration device. In this case, no visible rollers which interfere with the visual appearance remain in the interior of the refrigeration device.

"Refrigeration device" is understood in particular, therefore, as a domestic appliance, i.e. a refrigeration device which is used for household management in the home or in the catering field and which is used, in particular, to store foodstuffs and/or beverages at specific temperatures, such as for example a refrigerator, an upright freezer, a combined fridge-freezer, a chest freezer or a wine cooler.

In an advantageous embodiment, the shelf is encompassed on the edge by a guide rail. As a result, the technical advantage is achieved that the positioning surface of the shelf is configured to be free from guide elements or guide rails. Moreover, when the tray is not inserted into the interior, the positioning surface may be used as a depositing surface for refrigerated items. Thus the number of potential uses of the refrigeration device is increased.

In a further advantageous embodiment, the guide rail comprises guide surfaces which cooperate with roller side walls of the rollers. As a result, the technical advantage is achieved in that the tray follows a predefined movement path when displaced on the shelf and does not have to be controlled and/or steered. This increases the ease of use of the refrigeration device.

In a further advantageous embodiment, a pull-out lock is provided, said pull-out lock limiting a displacement of the tray on the shelf in the pulled-out direction. As a result, the technical advantage is achieved that a displacement of the tray on the shelf is prevented beyond a point on the movement path at which the refrigerated items stored on the tray would cause the tray to tip up. Thus, the safety is improved when using the refrigeration device.

In a further advantageous embodiment, a push-in lock is provided, said push-in lock limiting a displacement of the tray on the shelf in the pushed-in direction.

As a result, the technical advantage is achieved that the tray is prevented from striking against a rear wall which defines the interior of the refrigeration device. Thus the rear wall is prevented from being damaged.

In a further advantageous embodiment, the shelf is manufactured from glass. As a result, the technical advantage is achieved that the shelf and thus the refrigeration device as a whole have a visually attractive appearance.

In a further advantageous embodiment, the tray has a base made from glass. As a result, the technical advantage is achieved that the tray and thus the refrigeration device as a whole have a visually attractive appearance.

In a further advantageous embodiment, the rollers are manufactured from rubber. As a result, the technical advantage is achieved that the displacement of the tray on the shelf results in only a small degree of noise development.

In a further advantageous embodiment, a positive-fit shell is inserted into the tray. As a result, the technical advantage is achieved that refrigerated items which are shapeless, liquid and/or pourable may be stored in the shell and, if required, removed together with the tray, wherein by the positive insertion of the shell an undesired displacement of the shell on the tray is reliably prevented during the displacement of the tray in the interior of the refrigeration device or even outside the interior of the refrigeration device.

According to a second feature, the object according to the invention is achieved by a tray for arranging on a shelf which is arranged in an interior of a refrigeration device, wherein the tray comprises rollers so as to be supported on the shelf. As a result, the technical advantage is achieved that the tray may be removed with the refrigerated items on the tray as a whole from the interior of the refrigeration device. Thus, the transport of a plurality of refrigerated items is thereby simplified.

In an advantageous embodiment, a stop is provided for cooperating with a pull-out lock of the refrigeration device, and which limits a displacement of the tray in the pulled-out direction on the shelf. As a result, the technical advantage is achieved that a displacement of the tray on the shelf is prevented beyond a point on the movement path at which the refrigerated items stored on the tray would cause the tray to tip up. Thus, the safety is improved when using the refrigeration device.

In a further advantageous embodiment, a push-in stop is provided for cooperating with a push-in lock of the refrigeration device, and which limits a displacement of the tray in the pushed-in direction on the shelf. As a result, the technical advantage is achieved that the tray is prevented from striking against a rear wall which defines the interior of the refrigeration device. Thus the rear wall is prevented from being damaged.

In a further advantageous embodiment, the tray has a base made from glass. As a result, the technical advantage is achieved that the tray and thus the refrigeration device as a whole have a visually attractive appearance.

In a further advantageous embodiment, the rollers are manufactured from plastic. As a result, the technical advantage is achieved that the displacement of the tray on the shelf results in only a small degree of noise development.

Further exemplary embodiments are described with reference to the accompanying drawings, in which.

Figure 1:
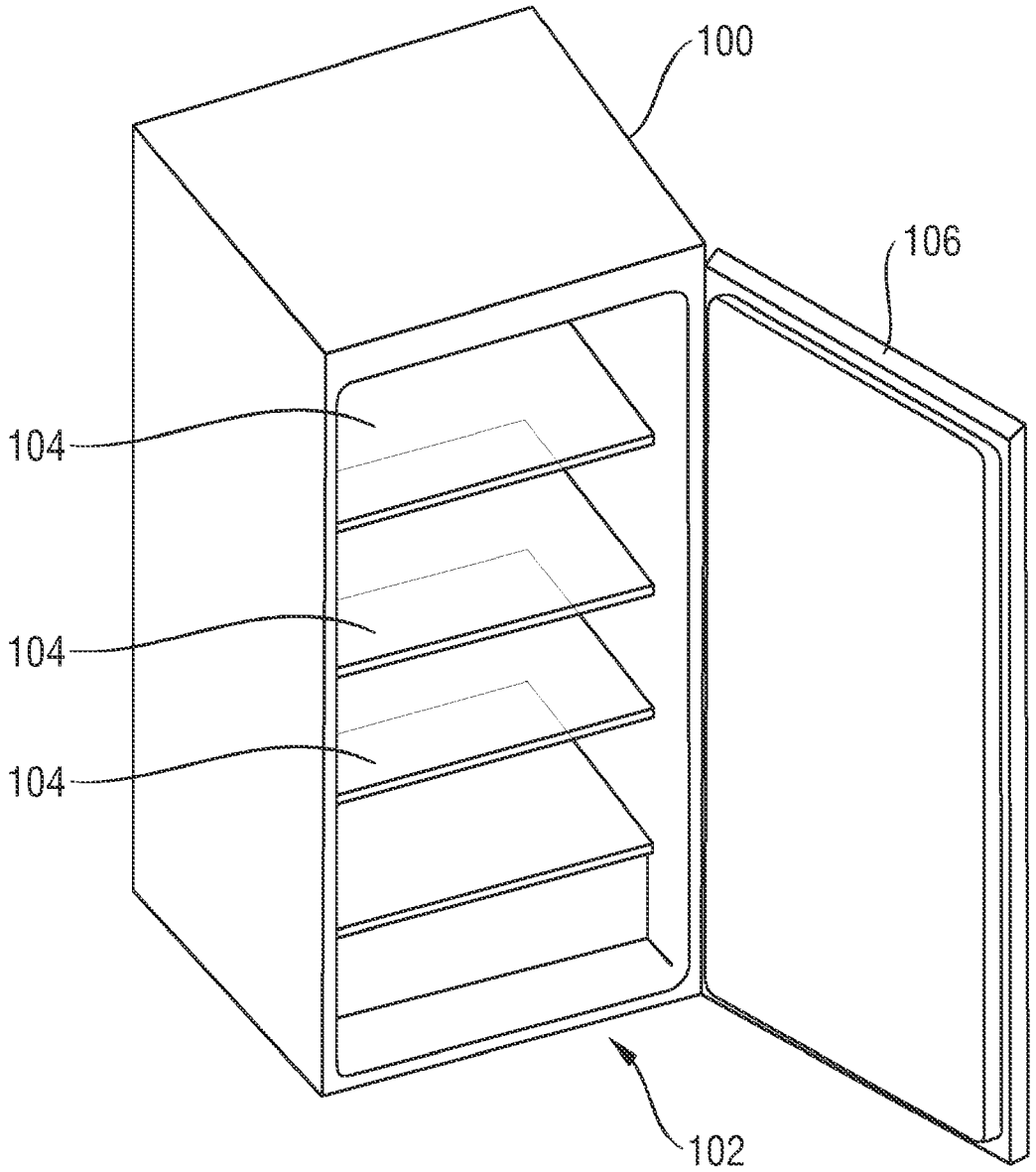
FIG. 1 shows a front view of a refrigeration device.

FIG. 1 shows a refrigerator as an exemplary embodiment of a refrigeration device 100 having a refrigerator door 106. By means of the refrigerator door 106, an interior 102, in which a plurality of shelves 104 are arranged, may be opened and closed again. In the present exemplary embodiment, the shelves 104 are fixedly arranged in the interior 102. Moreover, in the present exemplary embodiment the shelves 104 are manufactured from glass. However, they may be manufactured from another optically transparent material or even from an optically non-transparent material. Items to be refrigerated may be deposited on the shelves for the cold storage of said items.

The refrigerator serves, for example, for refrigerating foodstuffs and comprises a coolant circuit with an evaporator (not shown), a compressor (not shown), a condenser (not shown) and a throttle member (not shown).

The evaporator is configured as a heat exchanger in which, after expansion, the liquid coolant is evaporated by the absorption of heat from the medium to be cooled, i.e. air in the interior of the refrigerator.

The compressor is a mechanically driven component which draws in coolant vapor from the evaporator and discharges it to the condenser at a higher pressure.

The condenser is configured as a heat exchanger in which, after compression, the evaporated coolant is condensed by the output of heat to an external cooling medium, i.e. the surrounding air.

The throttle member is a device for the continuous reduction of pressure by reducing the cross-section.

The coolant is a fluid which is used for the transmission of heat in the cold-generating system which at low temperatures and low pressure of the fluid absorbs heat and at a higher temperature and higher pressure of the fluid discharges heat, wherein it is generally implicit that the state of the fluid is altered.

Figure 2:
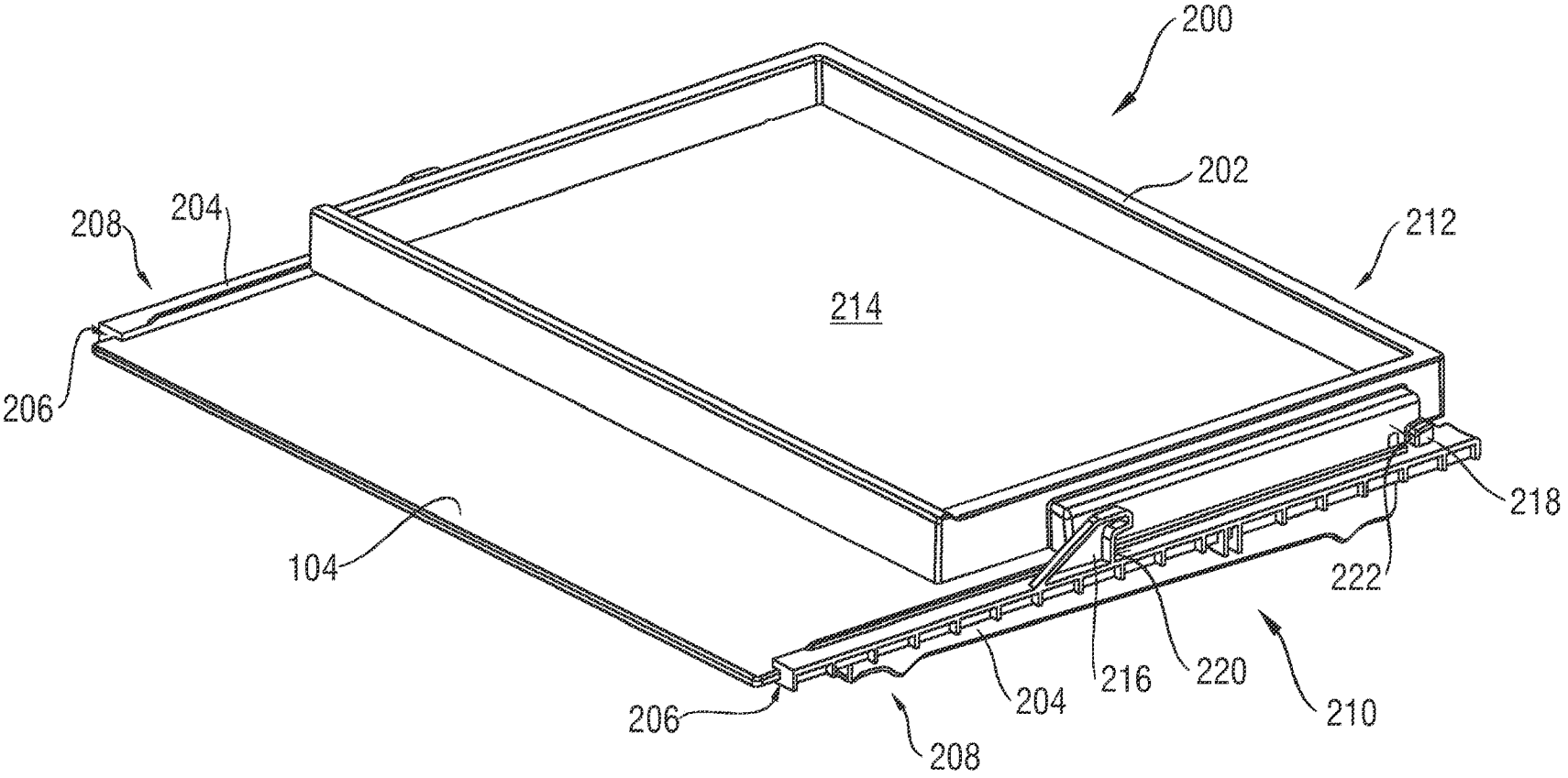
FIG. 2 shows a perspective view of a shelf with a tray.

FIG. 2 shows that the shelf 104 has two guide rails 204 on two opposing longitudinal sides 208. The guide rails 204 have a U-shaped cross-section in the direction of their longitudinal extent so that they have one respective groove 206 into which the respective edge portions of the shelf 104 on the longitudinal sides penetrate. The guide rails 204 serve for the fixed fastening of the shelf 104 in the interior 102 of the refrigeration device 100, by being connected to the inner side walls of the refrigeration device 100.

A tray 200 is arranged on the shelf 104. In the present exemplary embodiment, the tray 200 has a peripheral edge 202 and a base 214 which is encompassed by the edge 202 and which is configured as a positioning surface for refrigerated items to be cooled. In the present exemplary embodiment, the base 214 is manufactured from glass. However, it may also be manufactured from another optically transparent material or even from an optically non-transparent material.

It is possible that the tray 200 is able to be displaced on the shelf 104 in the direction of the longitudinal extent of the guide rails 204, so that when the refrigerator door 106 is open, the tray 200 supported on the shelf 104 may be at least partially displaced from the interior 102 of the refrigeration device 100 in order to place refrigerated items to be cooled on the shelf 104 and/or to remove said items therefrom. This displacement is limited by a pull-out lock 210 which has a stop 216 arranged on the guide rail 204 and a counter-stop 218 arranged on the frame 202. The stop 216 has a contact surface 220 and the counter-stop 218 has a counter-contact surface 222 which, when the maximum pulled-out position defined by the pull-out lock 210 is reached, come into contact with one another and thus prevent a further displacement of the tray 200.

After refrigerated items have been placed on the base 214 or removed therefrom, the tray 200 may be subsequently displaced again into the interior 102 and the interior 102 closed again by the refrigerator door 106. In this case, a push-in lock 212 which limits a displacement of the tray 200 on the shelf 104 in the pushed-in direction prevents the tray 200 from striking against a rear wall defining the interior 102 of the refrigeration device 100.

Figure 3:
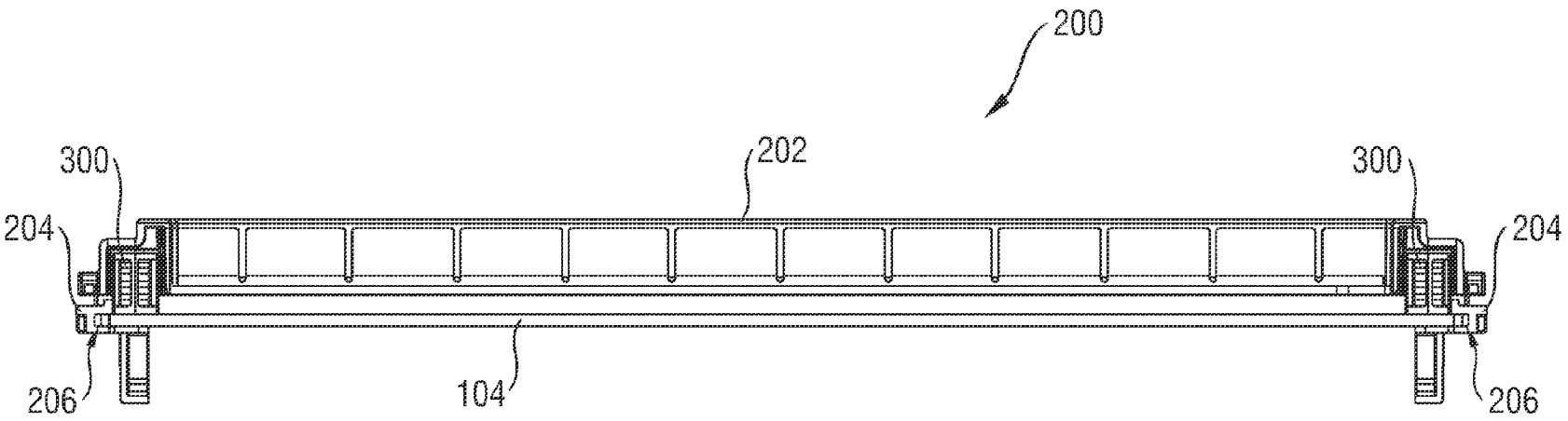
FIG. 3 shows a sectional view through the shelf shown in FIG. 2 with a tray.

FIG. 3 shows that the tray 200 has rollers 300 which are arranged on its opposing longitudinal sides 208 and which roll on the shelf 104 during the displacement of the tray 200. The rollers 300 in the present exemplary embodiment are manufactured from plastic. However, they may also be manufactured from a rubber-like material having similar mechanical properties.

Figure 4:
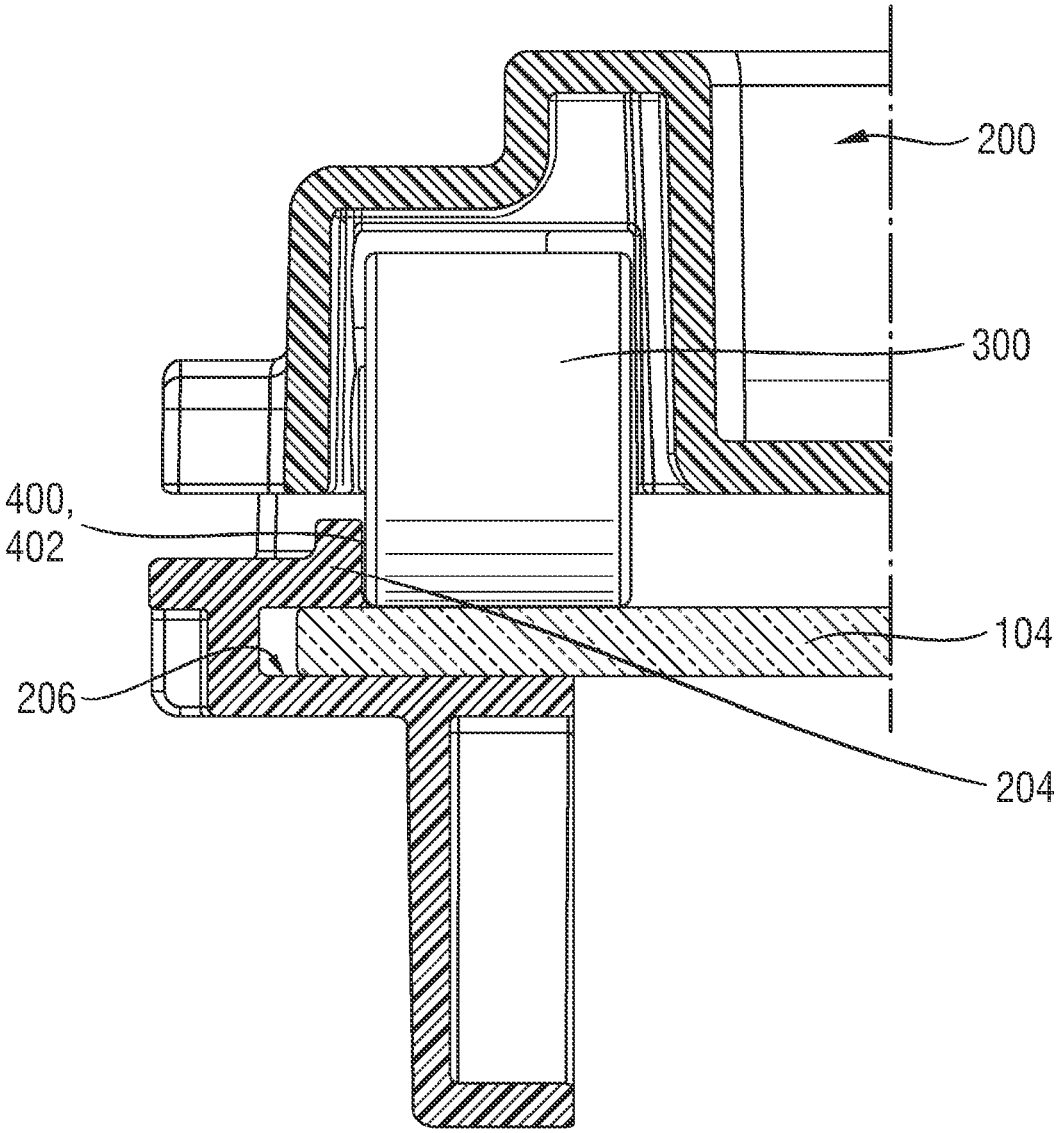
FIG. 4 shows an enlarged portion of FIG. 3.

FIG. 4 shows that the rollers 300 have two respective roller side walls, the external roller side wall 402 thereof cooperating with a guide surface 400 of the guide rail 204, in order to guide the tray 200 during a displacement on the shelf 104. Thus, in the present exemplary embodiment, the planes of the roller side wall 402 and the guide surface are parallel to one another, while the plane of the shelf 104 is arranged at right angles thereto.

Figure 5:
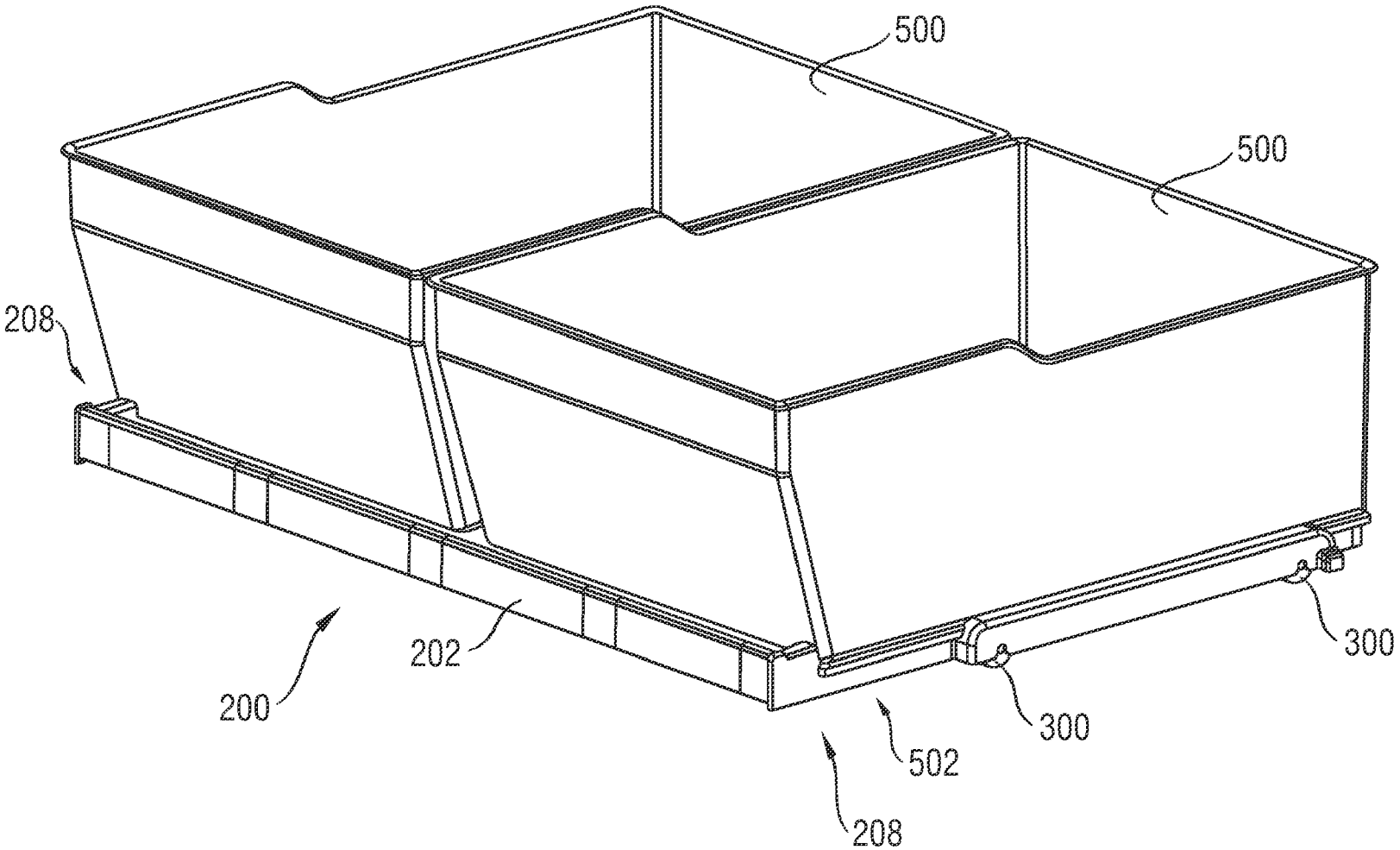
FIG. 5 shows a perspective view of a tray with two shells.

FIG. 5 shows two shells 500 inserted into the frame 202 of the tray 200. Refrigerated items which are shapeless, liquid and/or pourable may be stored in the shells 500 and, if required, removed together with the tray. The shells 500 have in this case a base portion 502 which is configured for positive insertion into the frame 202 of the tray 200. Thus the shells 500 inserted into the frame 202 are not subjected to any undesired displacement if the tray 200 with the shells 500 is displaced out of the interior 102 of the refrigeration device 100 or into said interior. Moreover, an undesired displacement of the shells 500 on the tray 200 is also reliably prevented if the tray 200 with the shells 500 is lifted from the shelf 104 and removed from the interior 102 of the refrigeration device 100 in order to be placed with the refrigerated items in the shells 500 on a table.

FIG. 5 also shows that in the pulled-out and/or pushed-in direction, i.e. in the direction of the longitudinal extent of the guide rails 204, two respective rollers 300 are arranged spaced apart from one another on each longitudinal side 208.

Thus, after opening the interior 102 of the refrigeration device 100 by pivoting the refrigerator door 106, the tray 200 may be displaced out of the interior 102 by rolling the rollers 300 on the shelf 104 until the pull-out lock 210 stops this displacement process. Now the refrigerated items may be removed from the shells 500 or placed there if a shell 500 is inserted into the frame 202. If no shell 500 is used, refrigerated items may be placed on the base 214 of the tray 200 or removed therefrom. Alternatively, the tray 200, with or without the shell 500 and/or shells 500, may also be completely lifted up from the shelf 104 and removed from the interior 102 of the refrigeration device 100 in order to place it, for example, on a table.

After use, the tray 200 may be placed again with its rollers 300 on the shelf 104 and/or displaced into the interior 102 of the refrigeration device depending on whether the tray 200 has been lifted up from the shelf 104 or merely displaced out of the interior 102. Finally, the interior 102 of the refrigeration device 100 may be closed again by pivoting the refrigerator door 106.

LIST OF REFERENCE CHARACTERS

100 Refrigeration device
102 Interior
104 Shelf
106 Refrigerator door
200 Tray
202 Frame
204 Guide rail
206 Groove
208 Longitudinal side
210 Pull-out lock
212 Push-in lock
214 Base
216 Stop
218 Counter-stop
220 Contact surface
222 Counter-contact surface
300 Roller
400 Guide surface
402 Roller side wall
500 Shell
502 Base portion

The invention claimed is:

1. A refrigeration device comprising an interior in which a shelf is arranged, the refrigeration device further including a tray supported in a displaceable manner relative to the shelf, the tray including a base configured to support items to be cooled, the tray having rollers connected thereto, the rollers being positioned to roll on the shelf along with the tray during displacement of the tray, the rollers defining a rolling plane that is positioned below the base, wherein the refrigeration device further comprises a pair of guide rails fixedly installed on opposing sides of the interior, wherein:

the shelf is installed within the refrigeration device by the pair of guide rails; and each guide rail includes an internal guide surface configured to prevent lateral movement of the tray by abutting an external side wall of a respective roller.

2. The refrigeration device as claimed in claim 1, wherein the shelf is encompassed on an edge by the guide rail.

3. The refrigeration device as claimed in claim 1, wherein a pull-out lock is provided, said pull-out lock limiting a displacement of the tray on the shelf in the pulled-out direction.

4. The refrigeration device as claimed in claim 1, wherein a push-in lock is provided, said push-in lock limiting a displacement of the tray on the shelf in the pushed-in direction.

5. The refrigeration device as claimed in claim 1, wherein the shelf is manufactured from glass.

6. The refrigeration device as claimed in claim 1, wherein the base is made from glass.

7. The refrigeration device as claimed in claim 1, wherein the rollers are manufactured from plastic.

8. The refrigeration device as claimed in claim 1, wherein a positive-fit shell is inserted into the tray.

9. A tray for arranging on a shelf which is arranged in an interior of a refrigeration device, wherein the tray has rollers configured to be supported on the shelf, the tray includes sidewalls and a solid base configured to support items to be cooled, and the rollers define a rolling plane corresponding to a top surface of the shelf in use that is positioned below the base;

wherein at least a first roller protrudes below the base such that an external side wall of the first roller is configured to abut a vertical wall arising from the shelf to prevent lateral movement of the tray;

wherein the rollers are configured to roll along the shelf with the tray during a displacement of the tray.

10. The tray as claimed in claim 9, wherein a stop is provided for cooperating with a pull-out lock of the refrigeration device, which limits a displacement of the tray on the shelf in the pulled-out direction.

11. The tray as claimed in claim 10, wherein a push-in stop is provided for cooperating with a push-in lock of the refrigeration device, which limits a displacement of the tray on the shelf in the pushed-in direction.

12. The tray as claimed in claim 9, wherein the base comprises glass.

13. The tray as claimed in claim 9, wherein the rollers are manufactured from plastic.

14. The tray as claimed in claim 9, wherein a positive-fit shell is inserted into the tray.

15. The tray as claimed in claim 1, wherein the tray and its rollers are removable from the shelf when the refrigeration device is open, in which case no visible rollers associated with movement of the tray remain within the interior of the refrigeration device.

16. The refrigeration device according to claim 8, wherein the positive-fit shell is configured to be liquid-tight.

17. A refrigeration device, comprising:

an interior compartment;

a shelf fixedly installed within the interior compartment;

a tray removably installed on the shelf, the tray being longitudinally displaceable within the interior compartment when installed;

wherein:

the shelf comprises a guide rail arranged along a lateral edge of the shelf;

the tray comprises sidewalls and a solid base configured to support items placed thereon to be cooled;

the tray comprises a roller housing arranged laterally to the base inside which at least one vertical roller is arranged; and the guide rail includes an inner facing guide surface configured to prevent lateral movement of the tray by abutting an external side wall of the at least one roller arranged to protrude below the base from within the roller housing.

18. The refrigeration device according to claim 17, wherein the roller housing is configured such that the rollers are not visible from above the tray.

19. The refrigeration device according to claim 17, wherein the tray is configured to have a depth such that items which are shapeless, liquid, and/or pourable may be placed within the tray.

20. The tray according to claim 9, wherein the tray includes a first roller housing arranged on a first lateral side of the tray comprising a first vertical inner wall and a first vertical outer wall with at least the first roller disposed between the first vertical inner wall and the first vertical outer wall and a second roller housing arranged on a second lateral side of the tray comprising a second vertical inner wall and a second vertical outer wall with at least a second roller disposed between the second vertical inner wall and the second vertical outer wall.

21. The tray according to claim 20, wherein the first inner wall and the second inner wall define outer boundaries of the base.

22. The tray according to claim 20, wherein the first roller housing and second roller housing prevent the first roller and the second roller, respectively, from being visible from a position above the tray.

23. The refrigeration device according to claim 1, wherein the shelf extends a full length between the pair of guide rails and each of the rollers is positioned to roll on a portion of the shelf that is spaced laterally inwards from a respective one of the guide rails.

24. The refrigeration device according to claim 17, wherein the shelf extends a full length between a pair of guide rails.

25. The tray according to claim 9, wherein the tray with the roller connected thereto is configured to be separated from the shelf and to be removed from the interior of the refrigeration device, and wherein the tray is configured to roll on a table exterior to the refrigeration device.

* * * * *